US011994301B2

(12) United States Patent
Adam et al.

(10) Patent No.: US 11,994,301 B2
(45) Date of Patent: May 28, 2024

(54) HOUSEHOLD COOKING APPLIANCE HAVING A COOKING CHAMBER CAMERA AND METHOD FOR OPERATION

(71) Applicant: BSH Hausgeräte GmbH, Munich (DE)

(72) Inventors: Julien Adam, Lingolsheim (FR); Sebastien Flesch, Gerstheim (FR)

(73) Assignee: BSH Hausgeräte GmbH, Munich (DE)

( * ) Notice: Subject to any disclaimer, the term of this patent is extended or adjusted under 35 U.S.C. 154(b) by 458 days.

(21) Appl. No.: 17/441,308

(22) PCT Filed: Mar. 25, 2020

(86) PCT No.: PCT/EP2020/058392

§ 371 (c)(1),
(2) Date: Sep. 21, 2021

(87) PCT Pub. No.: WO2020/200969

PCT Pub. Date: Oct. 8, 2020

(65) Prior Publication Data

US 2022/0163213 A1 May 26, 2022

(30) Foreign Application Priority Data

Apr. 5, 2019 (EP) ..... 19290021

(51) Int. Cl.
*F24C 7/08* (2006.01)

(52) U.S. Cl.
CPC ..... *F24C 7/085* (2013.01)

(58) Field of Classification Search
CPC ..... F24C 7/085
USPC ..... 382/100
See application file for complete search history.

(56) References Cited

U.S. PATENT DOCUMENTS

| | | | |
|---|---|---|---|
| 2007/0246453 | A1 | 10/2007 | Cho |
| 2014/0026762 | A1 | 1/2014 | Riefenstein |
| 2014/0199455 | A1 | 7/2014 | Bilet |
| 2020/0182481 | A1 | 6/2020 | Bhogal |
| 2020/0267996 | A1 | 8/2020 | Born |

FOREIGN PATENT DOCUMENTS

| | | | |
|---|---|---|---|
| CN | 108919721 | A | 11/2018 |
| DE | 102011002187 | A1 | 10/2012 |
| KR | 20160069344 | A | 6/2016 |
| WO | 2009138359 | A2 | 11/2009 |
| WO | 2018100956 | A1 | 6/2018 |

OTHER PUBLICATIONS

International Search Report PCT/EP2020/058392 dated Jun. 23, 2020.

*Primary Examiner* — Stephen P Coleman
(74) *Attorney, Agent, or Firm* — Michael E. Tschupp; Andre Pallapies; Brandon G. Braun

(57) ABSTRACT

A household cooking appliance includes a cooking chamber delimited by a cooking chamber wall, and a cooking chamber camera located outside of the cooking chamber, for capturing an image from the cooking chamber through a viewing opening in the cooking chamber wall. The cooking chamber camera is movable during an operating sequence from a resting position into a capturing position in order to capture the image and back from the capturing position into the resting position after having captured the image, with the cooking chamber camera being subject to more heat from the cooking chamber in the capturing position than in the resting position.

12 Claims, 2 Drawing Sheets

HOUSEHOLD COOKING APPLIANCE HAVING A COOKING CHAMBER CAMERA AND METHOD FOR OPERATION

CROSS-REFERENCES TO RELATED APPLICATIONS

This application is the U.S. National Stage of International Application No. PCT/EP2020/058392, filed Mar. 25, 2020, which designated the United States and has been published as International Publication No. WO 2020/200969 A1 and which claims the priority of European Patent Application, Serial No. 19290021.5, filed Apr. 5, 2019, pursuant to 35 U.S.C. 119(a)-(d).

BACKGROUND OF THE INVENTION

The invention relates to a household cooking appliance having a cooking chamber, delimited by a cooking chamber wall, and a cooking chamber camera located outside of the cooking chamber, for capturing images from the cooking chamber through a viewing opening in the cooking chamber wall, wherein the cooking chamber camera is movable by the household cooking appliance. The invention further relates to a method for operating such a household appliance. The invention is advantageously applicable, in particular, to ovens.

WO 2015/185211 A2 discloses a heat treatment monitoring system which comprises a heat treatment appliance which comprises a heat treatment chamber and at least one light source fastening for attaching a light source for illuminating the inside of the heat treatment chamber; and a monitoring device which comprises a camera, a camera light source and a mounting part, wherein the mounting part is adapted to be releasably fastened to the light source fastening.

DE 10 2011 002 187 A1 discloses a household appliance having a treatment chamber and a door closing the treatment chamber. Assigned to the treatment chamber is a camera which is adapted and configured to forward captured images from the treatment chamber to a display apparatus. In order to protect the camera in the treatment chamber from excessive heat, in particular in the case of cooking appliances, a cooling apparatus is preferably arranged in addition to such a camera. Such a cooling apparatus may be provided, for example, by an intake air flow positioned adjacent to the camera or even by other cooling apparatuses, such as for example a Peltier element.

WO 2009/138359 A2 discloses a household appliance having an image detection device, in particular having an internal image detection device, as well as a method for detecting an internal state or operating state of such a household appliance. A method for reducing thermally induced energy losses in a household appliance to be opened and to be closed, in particular a refrigerator or heating appliance, having a hollow space, comprises that a thermodynamic system is able to be received in the household appliance.

BRIEF SUMMARY OF THE INVENTION

It is the object of the present invention to overcome at least partially the drawbacks of the prior art and, in particular, to provide a possibility of capturing images from a cooking chamber of a household cooking appliance which may be implemented in a cost-effective manner, which may be easily mounted and which is reliable, durable and adaptable in a flexible manner.

This object is achieved according to the features of the independent claims. Advantageous embodiments form the subject of the dependent claims, the description and the drawings.

The object is achieved by a household cooking appliance having a cooking chamber, delimited by a cooking chamber wall, and a cooking chamber camera located outside of the cooking chamber, for capturing images from the cooking chamber through a viewing opening in the cooking chamber wall, wherein

- the cooking chamber camera is movable by the household cooking appliance between a resting position and a capturing position,
- the cooking chamber camera is subject to more heat from the cooking chamber in the capturing position than in the resting position and
- the household cooking appliance is designed to move the cooking chamber camera during an operating sequence, in order to capture an image, from the resting position into the capturing position and back into the resting position after the capture.

This household appliance has the advantage that in the resting position it is able to be well protected relative to thermal influences from the cooking chamber and is only moved into the capturing position, which is subject to greater thermal stress, for capturing an image. In the capturing position the cooking chamber camera obtains a better field of view than in the resting position. Thus in comparison with a cooking chamber camera permanently located in the region of the capturing position, a considerably reduced thermal stress is achieved. In particular, therefore, in this household appliance the cooking chamber camera is not only moved into the resting position, which is thermally more advantageous but optically less advantageous, when a critical cooking chamber temperature is reached, for example. Rather, the resting position corresponds to a "normal position" which the cooking chamber camera only leaves—as briefly as possible—in particular in order to capture a picture from the cooking chamber. The cooking chamber camera is thus generally located in its resting position. If, for example, an image from the cooking chamber is to be captured every minute and if the capture of an image requires, for example, 12 seconds, including the movement of the cooking chamber camera, the cooking chamber camera is located in the thermally advantageous resting position for 80% of its time. In the capturing position, the cooking chamber camera is located, in particular, sufficiently close to the viewing opening that the viewing opening does not restrict the field of view of the camera or not to a significant extent.

In comparison with cameras which are permanently spaced apart from the viewing opening and thus either have a restricted field of view, or fixed lenses are arranged in front thereof for maintaining a wide field of view, the advantage results that in the capturing position the camera has a wide field of view even without optical elements arranged in front. This reduces, for example, component costs and mounting costs (for example since no alignment of optical elements arranged in front is required) and is, in particular, robust and durable. Additionally, such a camera system is able to be used in a particularly flexible manner since it may be adapted rapidly and easily to different household cooking appliances.

In a development, the household cooking appliance is an oven or has an oven (for example is a cooker). The oven may additionally have a microwave function and/or a steam treatment function. The household cooking appliance may, however, also be a separate microwave appliance, optionally with at least one additional IR radiator or resistance heating element. Specifically in the case of an oven, the cooking chamber wall may also be denoted as the muffle.

In a development, the cooking chamber has, in particular, a loading opening on the front side which is closable by means of a door.

The cooking chamber camera may have at least one image sensor such as a CCD chip. The cooking chamber camera may have at least one primary optics arranged in front of the image sensor. The primary optics comprises one or more optical elements, for example one or more lenses which represent components of the camera and thus may be moved with the camera. The cooking chamber camera may be a component of an, in particular, housed camera module which, for example, may also comprise a camera electronics system.

The viewing opening may be arranged in principle at any position in the cooking chamber wall, for example on a left-hand or right-hand side wall of the cooking chamber, in the region of a ceiling of the cooking chamber, at the transition between the wall regions, etc. Generally the household appliance may have one or more such cooking chamber cameras with differently positioned viewing openings.

In a development, the household cooking appliance has at least one drive means for moving the cooking chamber camera, for example an electric motor, an actuator, (for example at least one piezo actuator), etc. The cooking chamber camera may cooperate with one or more guides for the guided movement thereof, for example with rails or longitudinal grooves. The movement of, in particular, a mechanical drive means may be transmitted, for example, via a corresponding force transmission apparatus or motion transmission apparatus to the camera, optionally with a stroke multiplication or stroke reduction. The motion transmission apparatus may comprise, for example, a toothed gearing, a cable pull, a threaded rod assembly, etc.

In a development, the camera starts immediately to capture an image (i.e. without a specifically provided pause) after reaching the capturing position. In a development, the camera is moved back into the resting position immediately after the capture of an image or a continuous image sequence. This results in the advantage that a dwell time in the capturing position is kept particularly short, which is thermally advantageous.

The movement of the camera and the triggering of a capture of an image by the camera may be undertaken by means of a control apparatus of the household cooking appliance, in particular a central control apparatus.

In an embodiment, in the resting position the cooking chamber camera is moved further away from the cooking chamber than in the capturing position. As a result, a [reduction in the] thermal stress of the cooking chamber camera may be implemented in a particularly simple manner in the resting position.

In an advantageous embodiment for the particularly simple and compact implementation of the camera movement, the cooking chamber camera is movable in a rectilinear manner between the resting position and the capturing position, in particular in a tubular channel. The track of the cooking chamber camera between the resting position and the capturing position, as a result, is a rectilinear track.

Alternatively or additionally, the cooking chamber camera may be moved to the side or laterally so that the cooking chamber camera is then separated from the cooking chamber in the resting position by the cooking chamber wall and optionally by a thermal insulating layer surrounding the cooking chamber wall. To this end, the cooking chamber camera may only be moved laterally or it may be displaced into a resting position further removed from the cooking chamber, wherein the cooking chamber camera is additionally offset at that point to the side relative to the viewing opening. This may be implemented, for example, by a curved track between the resting position and the capturing position. This may provide the additional advantage that the cooking chamber camera is turned relative to the viewing opening and thus potentially even better protected from the thermal radiation passing through the viewing opening. For example, the curved track may adopt the shape of a circular sector or an oval sector.

In an embodiment, the region between the viewing opening and the cooking chamber camera is free of fixed optical elements. Thus the advantage is achieved that the cooking chamber camera in its capturing position may be moved particularly close to the viewing opening and as a result may use a particularly wide field of view. In this case, also in general, the viewing opening itself may [words missing here] from a In an embodiment, the viewing opening is covered by means of an optically transparent cover element. Thus the advantage is achieved that the cooking chamber camera is even better protected against heat otherwise passing through the viewing opening from the cooking chamber (thermal radiation and/or convection heat). For further protection against the passage of thermal radiation or infrared radiation the cover element may have a IR protective layer which is permeable in the visible range but not permeable to thermal radiation or only to a small degree (for example an IR reflective layer). In a development, the cover element consists of glass which advantageously is particularly resistant, for example in comparison with plastics.

In a development, the cover element is configured as a non-beam-forming element, for example as a pane of glass.

In a development, the cover element is configured as a beam-forming optical element, for example as a lens. As a result, the field of view of the cooking chamber camera may be further improved by simple means. For example, the cover element may be a lens widening the field of view of the cooking chamber camera. Advantageously, no further fixed optical element is located between the cover element configured as a beam-forming optical element and the cooking chamber camera, as already set forth above.

In an embodiment, the household cooking appliance has a closable screen which blocks an incidence of thermal radiation through the viewing opening onto the cooking chamber camera when the cooking chamber camera is in the resting position, and opens up a field of view of the cooking chamber camera when the cooking chamber camera is in the capturing position. Thus a thermal stress of the cooking chamber camera in the resting position may be even further reduced.

In an embodiment, the camera is also able to be turned or rotated. Thus the advantage is achieved that the spatial orientation of the camera, in particular in the resting position, is adjustable such that the thermal stress thereof may be even further reduced. For example, the camera may be turned—in particular with a linear displaceability or mobility—such that thermally less susceptible regions or surfaces thereof are oriented in the direction of the greatest thermal radiation. In a development, in particular in this embodiment but not limited thereto, the camera may be at least partially coated with a thermal protective layer, for example with an IR reflective layer, a thermal insulating layer and/or a particularly thermally resistant layer. The camera may be turned such that the thermally protective layer is oriented in the direction of the greatest thermal radiation. The thermally protective layer may also be denoted as a heat shield.

In an embodiment, the operating sequence is a sequence or process for treating food to be cooked ("cooking sequence"). The capture of images from the cooking chamber may thus be used, in particular, to establish or to monitor a cooking progress of food to be cooked located in the cooking chamber. For example, a degree of browning and/or a change in the volume of the food to be cooked may be monitored. However, the operating sequence may also be a non-cooking sequence, for example a cleaning sequence such as a pyrolysis process.

The object is also achieved by a method for operating a household cooking appliance having a cooking chamber, delimited by a cooking chamber wall, and a cooking chamber camera located outside of the cooking chamber, for capturing images from the cooking chamber through a viewing opening in the cooking chamber wall, wherein in the method during an operating sequence

- the cooking chamber camera is moved from resting position subject to less thermal stress, into a capturing position located closer to the viewing opening and subject to greater thermal stress,
- the cooking chamber camera is triggered to capture an image in the capturing position and then
- is moved from the capturing position back into the resting position.

The method may be configured in a similar manner to the household cooking appliance and vice versa, and has the same advantages.

In an embodiment, for each capture of an image the cooking chamber camera is moved from the resting position into the capturing position and back into the resting position. Thus a dwell time in the capturing position is advantageously kept particularly short. This embodiment may specifically comprise that the cooking chamber camera captures exactly one image in the capturing position before returning into the resting position. In other words, for each individual image the cooking chamber camera may be moved from the resting position into the capturing position and back. However, in principle, it is also possible that an image series is captured by means of the cooking chamber camera in the capturing position before returning into the resting position. In this case advantageously there are only short time intervals between individual images of the image series. In particular, the images of the image series then may be captured immediately in succession (i.e. without dedicated pauses).

In a development, the time period ("dwell time"), in which the cooking chamber camera is allowed to dwell for a maximum uninterrupted time in the capturing position, is predetermined and the cooking chamber camera is moved back into the resting position at the latest when this dwell time is reached. In a development, the dwell time may be dependent on the set target cooking chamber temperature or the measured cooking chamber temperature; the higher the temperature, the lower the maximum dwell time of the cooking chamber camera in the capturing position. In a further development, a time period ("rest time") of the cooking chamber camera in its resting position is predetermined. As a result, the advantage is achieved that the cooking chamber camera receives a specific time in the resting position in order to cool down. In a development, the rest time may also be dependent on the set target cooking chamber temperature or the measured cooking chamber temperature; the higher the temperature, the longer the rest time.

In a development, the cooking chamber camera is cooled in at least the resting position. To this end, one or more cooling apparatuses such as cool air channels, Peltier elements, etc. may be provided in the region of the resting position.

In an embodiment, when it is established that a critical cooking chamber temperature is reached or exceeded, a movement of the cooking chamber camera into the capturing position is prevented. Thus a further protective mechanism, which prevents an overheating of the cooking chamber camera, is provided.

BRIEF DESCRIPTION OF THE DRAWINGS

The above-described properties, features and advantages of this invention as well as the manner in which they are achieved will become clearer and more comprehensible in connection with the following schematic description of an exemplary embodiment which is described in more detail in connection with the drawings.

DETAILED DESCRIPTION OF EXEMPLARY EMBODIMENTS OF THE PRESENT INVENTION

Figure 3:
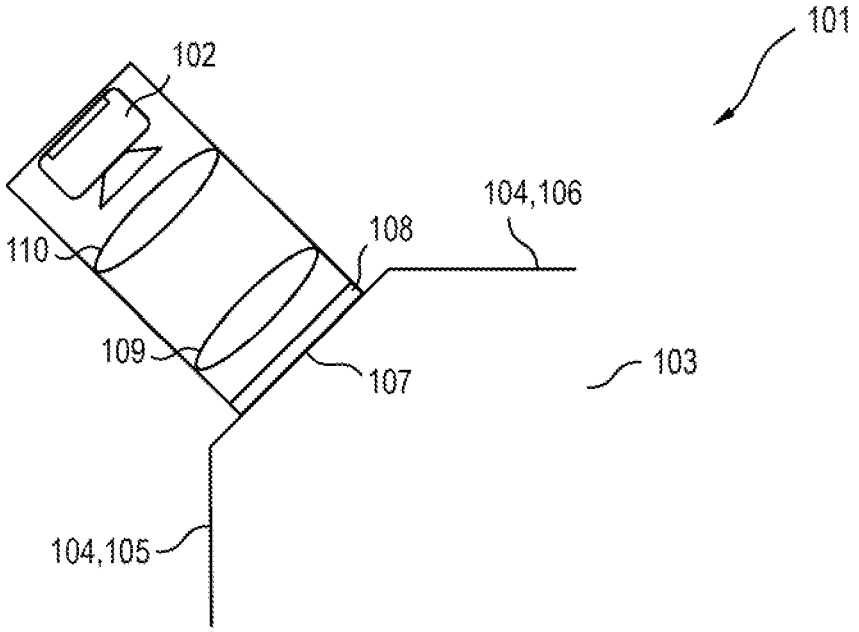
FIG. 3 shows in side view a detail of an oven in the region of a conventional cooking chamber camera, as a sectional view.

FIG. 3 shows in side view a detail of a household oven 101 in the region of a conventional fixed cooking chamber camera 102, as a sectional view. The oven 101 has a cooking chamber 103 which is delimited by a cooking chamber wall 104, a part of a side wall 105 thereof and a part of a ceiling 106 thereof being illustrated here. For example, a circular viewing opening 107 is incorporated in the cooking chamber wall 104 in a transition region between the side wall 105 and the ceiling 106. The viewing opening 107 is covered by an optically transparent cover element 108 which is provided to prevent a passage of hot air through the viewing opening 107 into a region of the oven 101 remote from the cooking chamber 102.

The cooking chamber camera 102 is located behind the cover element 108 on the side remote from the cooking chamber. The cooking chamber camera is installed in an immovable or, respectively, fixed manner in the oven 101 and faces the viewing opening 107. The cooking chamber camera is also at a significant spacing from the cover element 108 for the thermal protection thereof. As a result, a thermal stress of the cooking chamber camera 102 due to thermal radiation radiating through the cover element 108 from the cooking chamber 102 and optionally due to a heat dissipation through the cover element 108 itself is reduced.

A fixedly mounted or fixed intermediate optics, indicated here by the lenses 109 and 110, is located between the cooking chamber camera 102 and the cover element 108.

This has the advantage that a limited field of view of the cooking chamber camera 102, due to the spacing between the cooking chamber camera 102 and the cover element 108, may be increased. The lenses 109 and 110 may also optionally serve as thermal shielding elements.

A drawback with the oven 101, amongst other things, is that the lenses 109 and 110 have to be calibrated relative to one another and relative to the cooking chamber camera 102 in order to achieve a sharp image. This in turn increases a construction or, respectively, design time and an installation time and thus mounting costs. Moreover, the lenses 109 and 110 increase the costs for the oven 101.

Figure 1:
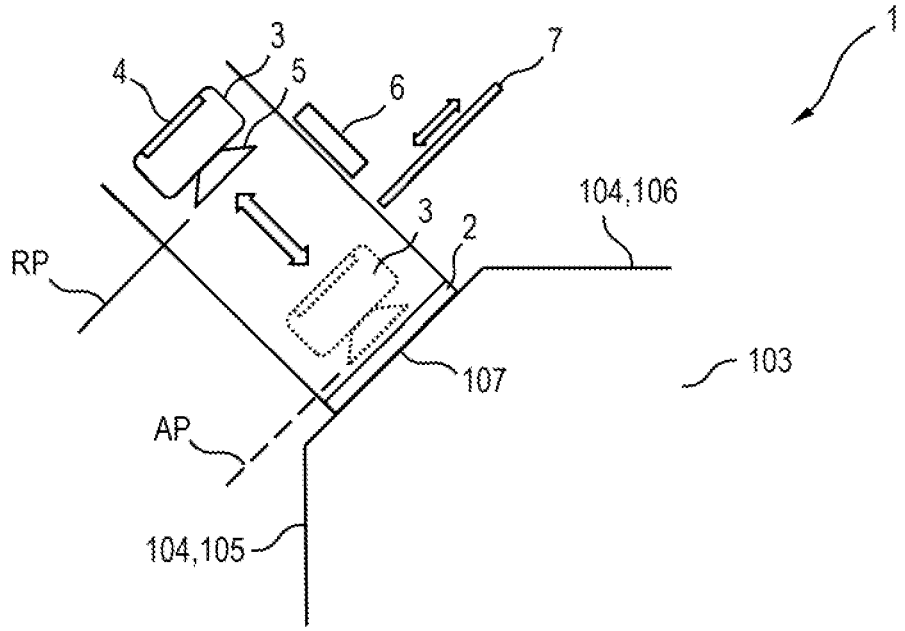
FIG. 1 shows in side view a detail of an oven in the region of a cooking chamber camera which is movable on a rectilinear track, as a sectional view.

FIG. 1 shows a household cooking appliance according to the invention in the form of an oven 1. The cooking chamber 103 and the cooking chamber wall 104-106 having the viewing opening 107 may be configured as in the case of the oven 101.

The viewing opening 107 is covered by a transparent cover element in the form of an optically non-beam-forming or, respectively, optically neutral glass pane 2. The glass pane 2 may have a layer which is optically transparent but which blocks IR radiation (for example reflective).

A camera 3 in the form of, in particular, a housed camera module is arranged behind the glass pane 2 on the side of the cooking chamber wall 104 remote from the cooking chamber 103. The camera 3 may have, for example, an image sensor 4, an electronic unit for activating the camera 3 and/or image processing and/or an objective 5 with one or more optical elements ("primary optics").

The camera 3 is movable automatically between a resting position RP remote from the viewing opening 107 and a capturing position AP located in the vicinity of the viewing opening 107. In particular, a spacing between the objective 5 and the cover pane 2 in the capturing position AP is minimal so that the camera 3 is provided with a particularly large field of view. This is achieved, in particular, by the lack of intermediate optics 109, 110 which are still required in the oven 101. The camera 3 is in the capturing position AP but is subject to significantly greater thermal stress in comparison with the resting position RP. Due to the lack of intermediate optics 109, 110 the oven 1 is more cost-effective and robust than the oven 101.

In order to be able to combine a particularly low thermal stress of the camera 3 with a wide field of view, the camera 3 is kept in the resting position until an image from the cooking chamber 103 is to be captured thereby. Then the camera 3 is moved or displaced into the capturing position AP, an image or a rapid image sequence is captured and, in particular, the camera is moved or displaced immediately afterwards back into the resting position RP. The images captured by means of the camera 3 during the course of an operating sequence may be used for following chronological developments in the cooking chamber 103, for example for tracking or monitoring a degree of browning or a change in the volume of food to be cooked during a cooking sequence.

In this case, the camera 3 is moved purely by way of example in a rectilinear manner and, in particular, perpendicular to the viewing opening 107. However, alternatively the camera 3 may also follow a curved track, for example.

A motor 6, for example an electric motor, is present for moving the camera 3, the drive movement thereof being converted into a movement of the camera 3, for example by means of a corresponding motion system (illustrated above). The motion system may generally have, for example, a motion transmission apparatus (for example a toothed gearing, a rod drive, a threaded drive rod for a spindle drive, a cable pull, etc.) In particular, a mechanical guide for predetermining the shape of the track of the camera 3 may also be present.

Optionally the oven 1 may have a screen 7 which blocks an incidence of thermal radiation through the viewing opening 107 onto the cooking chamber camera 3 when the cooking chamber camera 3 is in the resting position RP.

In a development, when it is established that a critical cooking chamber temperature is reached or exceeded, a movement of the cooking chamber camera 3 into the capturing position is prevented, for example by means of the control apparatus.

Figure 2:
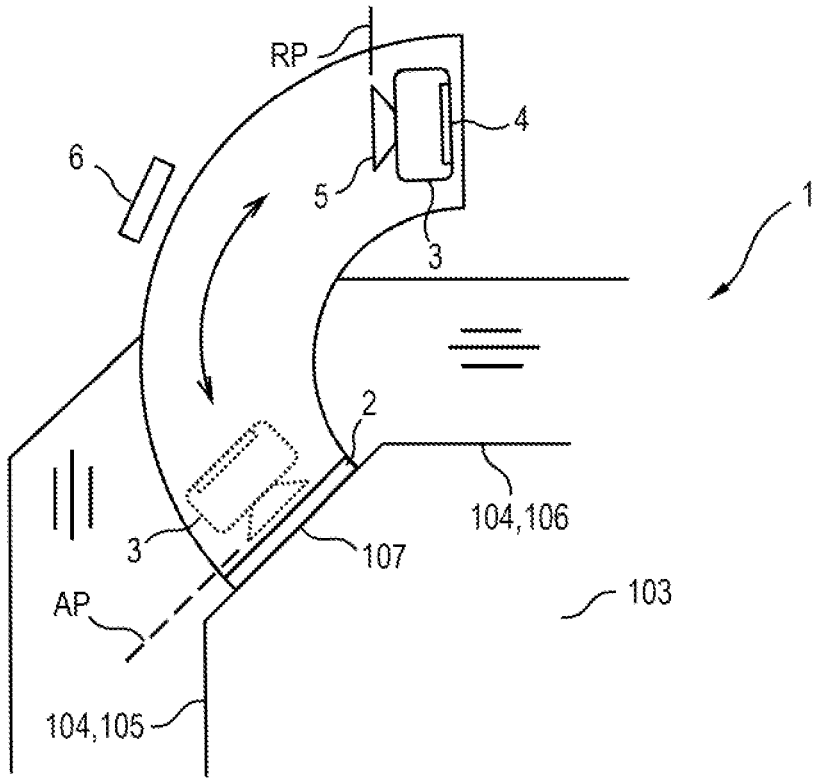
FIG. 2 shows in side view a detail of an oven in the region of a cooking chamber camera which is movable on a curved track, as a sectional view

FIG. 2 shows a household cooking appliance according to the invention in the form of an oven 8. The oven 8 is configured in a similar manner to the oven 1, wherein however the camera 3 is not moveable on a rectilinear track between the resting position RP and the capturing position AP as indicated by the double arrow, but on a curved track. This track is configured purely by way of example as a ring sector-shaped track. This provides the advantage that the camera 3 may be displaced into a region behind a thermal insulation 9 which is remote from the cooking chamber—in particular which is also present in the oven 1—and which advantageously may produce a further reduction in the thermal stress on the camera 3.

Naturally the present invention is not limited to the exemplary embodiment shown.

Thus a lens may be used as a cover element instead of the optically neutral glass pane 2, whereby the field of view of the cooking chamber camera 3 may be further adapted.

A screen 7 may also be present in the oven 8.

In a development, the camera 3, also in general, is also able to be turned or rotated about itself in order to adopt a particularly thermally advantageous orientation.

Additionally, a wall surrounding the track of the camera 3, in particular a tubular wall, may be coated with IR-absorbing material, in order to suppress a reflection of thermal radiation into the camera 3.

Generally "a", "an", etc. may be understood to mean a singular or a plural, in particular in the sense of "at least one" or "one or more", etc. provided this is not explicitly excluded, for example by the expression "exactly one", etc.

Numerical data may comprise exactly the specified number and also a usual tolerance range, provided this is not explicitly excluded.

The invention claimed is:

1. A household cooking appliance, comprising:

a cooking chamber delimited by a cooking chamber wall; and a cooking chamber camera located outside of the cooking chamber, for capturing an image from the cooking chamber through a viewing opening in the cooking chamber wall, said cooking chamber camera being movable during an operating sequence from a resting position into a capturing position in order to capture the image and back from the capturing position into the resting position after having captured the image, with the cooking chamber camera being subject to more heat from the cooking chamber in the capturing position than in the resting position.

2. The household cooking appliance of claim 1, wherein in the resting position the cooking chamber camera is moved further away from the cooking chamber than in the capturing position.

3. The household cooking appliance of claim 1, wherein a region between the viewing opening and the cooking chamber camera is free of a fixed optical element.

4. The household cooking appliance of claim 1, wherein the cooking chamber camera is movable in a rectilinear manner between the resting position and the capturing position.

5. The household cooking appliance of claim 1, wherein the cooking chamber camera is movable on a curved track between the resting position and the capturing position.

6. The household cooking appliance of claim 1, further comprising an optically transparent cover element designed to cover the viewing opening.

7. The household cooking appliance of claim 1, further comprising a closable screen designed to block an incidence of thermal radiation through the viewing opening onto the cooking chamber camera when the cooking chamber camera is in the resting position, and to open up a field of view of the cooking chamber camera when the cooking chamber camera is in the capturing position.

8. The household cooking appliance of claim 1, wherein the cooking chamber camera is mounted to enable turning thereof.

9. The household cooking appliance of claim 1, wherein the operating sequence is a cooking sequence.

10. A method for operating a household cooking appliance, said method comprising:

moving during an operating sequence a cooking chamber camera located outside of a cooking chamber of the household appliance from a resting position in which the cooking chamber camera is subject to less thermal stress, into a capturing position in which the cooking chamber camera is located closer to a viewing opening in a cooking chamber wall and subject to greater thermal stress;

triggering the cooking chamber camera in the capturing position to capture an image from the cooking chamber through the viewing opening; and moving the cooking chamber camera from the capturing position back into the resting position.

11. The method of claim 10, wherein for each capture of an image from the cooking chamber the cooking chamber camera is moved from the resting position into the capturing position and back from the capturing position into the resting position.

12. The method of claim 10, further comprising preventing the cooking chamber camera from moving into the capturing position when reaching or exceeding a critical cooking chamber temperature.

* * * * *